US007201533B2

(12) United States Patent
DeGreef

(10) Patent No.: US 7,201,533 B2
(45) Date of Patent: Apr. 10, 2007

(54) SEWER GRATE LOCKING MECHANISM AND METHOD OF INSTALLING SAME

(75) Inventor: Richard DeGreef, Shelby Township, MI (US)

(73) Assignee: Grate Sewer Lock Co., LLC, Lake Orion, MI (US)

( * ) Notice: Subject to any disclaimer, the term of this patent is extended or adjusted under 35 U.S.C. 154(b) by 73 days.

(21) Appl. No.: 10/780,780

(22) Filed: Feb. 18, 2004

(65) Prior Publication Data

US 2005/0196238 A1 Sep. 8, 2005

(51) Int. Cl.
*E02D 29/14* (2006.01)

(52) U.S. Cl. ..... 404/25; 52/19

(58) Field of Classification Search ..... 404/2, 404/4, 25, 26; 52/19, 20, 177, 202; 24/293, 24/294, 295

See application file for complete search history.

(56) References Cited

U.S. PATENT DOCUMENTS 887,591 A * 5/1908 Cook ..... 137/371
2,190,532 A * 2/1940 Lukomski ..... 210/164
3,279,838 A 10/1966 Hamilton
3,390,224 A * 6/1968 Wyatt ..... 174/37
4,655,913 A * 4/1987 Boersma ..... 210/163
4,723,866 A 2/1988 McCauley
4,763,449 A 8/1988 Vigneron et al.
4,871,451 A * 10/1989 Piskula ..... 210/164
4,964,755 A 10/1990 Lewis et al.
4,973,191 A * 11/1990 Dannhauser ..... 404/25
5,056,955 A 10/1991 Spiess et al.
5,071,177 A 12/1991 Spiess et al.
5,082,392 A 1/1992 Marchese et al.
5,234,582 A * 8/1993 Savoie ..... 210/163
5,849,198 A * 12/1998 Sharpless ..... 210/693
6,752,565 B2 * 6/2004 Schrage ..... 404/25
6,811,119 B1 * 11/2004 Petersen et al. ..... 244/114 R
2003/0147693 A1 * 8/2003 Knak et al. ..... 404/4

* cited by examiner

*Primary Examiner*—Raymond W. Addie
(74) *Attorney, Agent, or Firm*—Weide & Miller, Ltd.

(57) ABSTRACT

A conventional sewer grate has a locking mechanism for preventing removal of the grate from its mounting frame by unauthorized persons. The locking mechanism includes a grate hold-down device, a threaded nut attached to the mounting frame below the hold-down device, and a bolt extending downwardly through the hold-down device into threaded engagement with the nut. The head of the bolt is specially constructed so that a specially-formed wrench is required to unscrew the bolt from the nut.

9 Claims, 4 Drawing Sheets

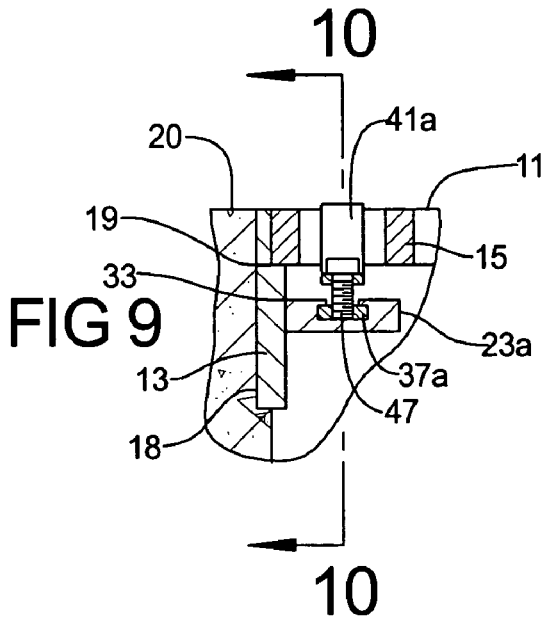
FIG 9
FIG 10
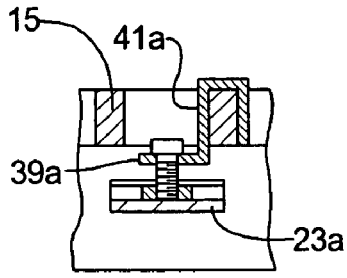
FIG 11
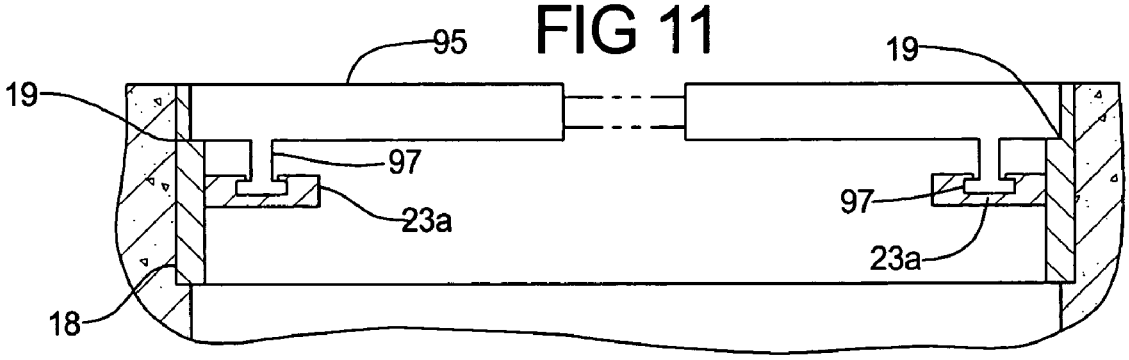
FIG 12
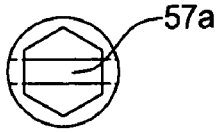
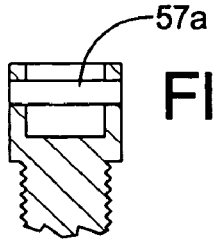
FIG 13

SEWER GRATE LOCKING MECHANISM AND METHOD OF INSTALLING SAME

BACKGROUND OF THE INVENTION

1. Field of the Invention

This invention relates to sewer grates commonly located near the curbs of paved roads for carrying away surface water. The invention is more particularly concerned with mechanisms for locking such grates in their mounting frames to prevent their theft.

2. Prior Art

Sewer grates are located along paved roadways to transport surface water into the underground storm drains. Such grates are commonly constructed out of cast iron. A typical grate has parallel spaced bars in a grid pattern, with the openings between the bars suited for receiving surface water. The upper surface of the grate is level with the road surface (i.e. the pavement).

Each grate is mounted on a cast iron frame embedded in the concrete pavement surface near the curb. The grate is commonly seated on an interior ledge in the frame, such that the grate can be readily removed, e.g. when it becomes necessary to clean out the storm drain.

A sewer grate usually weighs about one hundred fifty pounds. In spite of such a large weight, the grates are quite often stolen or at least removed from the mounting frames, as an act of vandalism. Thieves sell such grates to metal scrap dealers.

The stolen (removed) grates must be replaced, with consequent expense to the city. Also, before a replacement grate is installed, there is a potential danger that a vehicle (car or truck) will have its front or rear wheels pass over the drain opening. The impact damages the wheel and/or the vehicle suspension; personal injury damage can also occur. Motorists often sue the city government for negligence attributable to missing sewer grates. The opening created by a missing sewer grate is large enough that a small child can conceivably fall into the sewer, and be injured.

The following prior art represents attempts to anchor or lock a manhole cover in position to prevent theft.

| | | |
|---|---|---|
| 5,065,955 | Spiess | Locking Device for Coverings for Manholes and Other Ground Openings |
| 4,973,191 | Dannhauser | Manhole Cover |
| 5,071,177 | Spiess | Locking Device for the Positive Holding of a Cover or Grate in Frame |
| 4,964,755 | Lewis | Manhole Cover Lock Apparatus |
| 5,082,392 | Marchese | Manhole Cover Lock with Spring Biased Locking Bars |
| 4,763,449 | Vigneron | Manhole Cover Sealing and Locking Arrangement |
| 3,279,838 | Hamilton | Locking Securement for Sheet Metal Housing Cover |
| 4,723,866 | McCauley | Manhole Cover Locking Bolt Construction |

In practice, it is believed the structures disclosed these in patents are either expensive, complicated or ineffective.

U.S. Pat. No. 4,723,866 which was issued Feb. 9, 1988 to Durham McCauley shows a manhole cover locking mechanism with a special bolt head requiring a specially constructed wrench.

U.S. Pat. No. 3,279,838, which issued Oct. 18, 1966 to Douglas L. P. Hamilton, shows a locking bolt head having a diagonal opening with a central pin that requires an Allen wrench with a central cavity for receiving the pin when the Allen wrench is inserted in the opening.

SUMMARY OF THE INVENTION

The present invention relates to a locking mechanism for a conventional sewer grate, for deterring would-be thieves or vandals from removing the grate from its mounting frame. The locking mechanism, in its preferred form, comprises a grate hold-down means below the grate, and a threaded nut attached to the hold-down means. A bolt is passed through an opening in the grate and screwed into the nut, to lock the grate in the frame.

The bolt head is specially configured, requiring a specially constructed wrench to unscrew the bolt for removing the grate from its frame. Only authorized sewer maintenance personnel use the specially constructed wrenches for sewer clean-out or repair purposes. Unauthorized persons are normally unable to obtain the special wrenches.

The principal aim of the invention is to provide an improved grate locking mechanism requiring a special wrench for unlocking the mechanism. A related aim is to provide a low cost locking mechanism for conventional sewer grates, with minimal modification of the grate or its mounting frame.

THE DRAWINGS

FIG. 9 is a fragmentary section view through another locking mechanism embodying features of the invention.

FIG. 10 is a sectional view taken on line 10—10 in FIG. 9.

FIG. 11 is a transverse sectional view taken on a reduced scale through a grate mounting frame.

FIGS. 12 and 13 are views taken in the same direction as FIGS. 7 and 8, but illustrating another bolt construction that can be used in practicing of the invention.

DESCRIPTION OF A PREFERRED EMBODIMENT OF THE INVENTION

Figure 1:
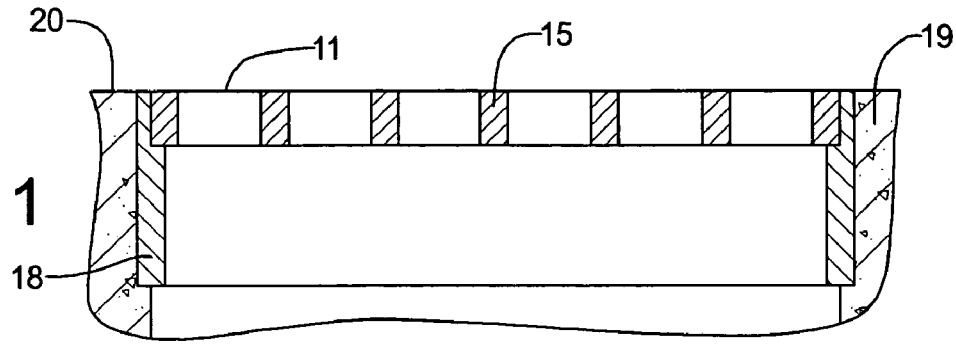
FIG. 1 is a cross sectional view through a conventional sewer grate and its mounting frame.
Figure 5:
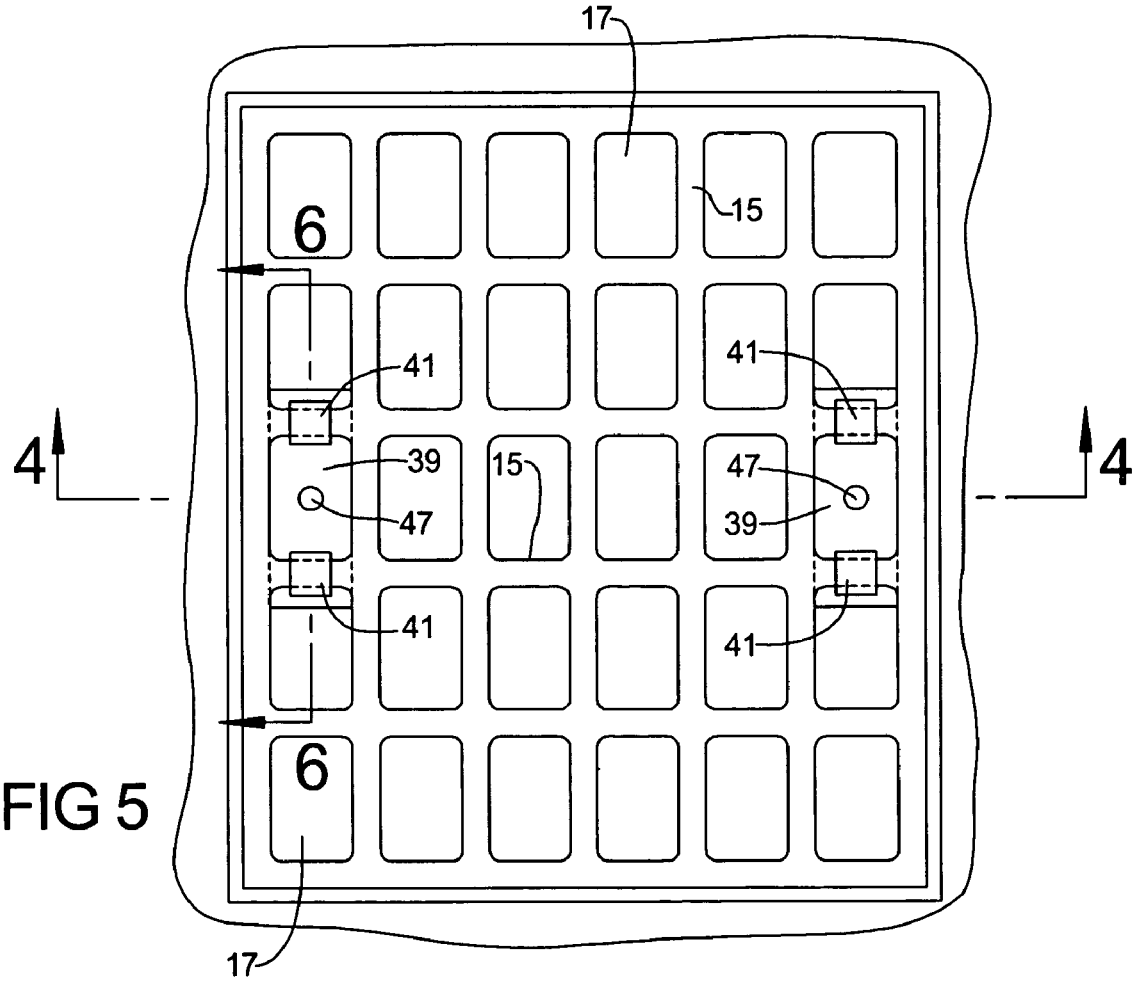
FIG. 5 is a top plan view of the structural assembly depicted in FIG. 4.

FIGS. 1 and 5 show a conventional rectangular sewer grate 11 mounted in a rectangular mounting frame 13. The grate is of one-piece cast iron construction that includes a series of bars 15 connected in a grid spaced to form drain openings 17. Typically, the grate weighs about one hundred fifty pounds. The grate has its outer peripheral edge area resting on ledges 19 formed in side walls 18 of the mounting frame. The edges are recessed a sufficient distance below the upper edge of frame 13 such that the upper surface of grate 11 is in the same plane as the concrete (or asphalt) pavement surface 20. Frame 13 is embedded in the pavement to form a permanent part of the road structure.

Usually the sewer grate is located near the curb of the roadway to receive surface rain water through drain openings 17.

The present invention is more particularly concerned with a locking mechanism for removably retaining grate 11 on frame 13. FIGS. 4 through 8 illustrate a preferred locking mechanism constructed according to the invention. The mechanism comprises two angle members 23 attached to opposite side walls of frame 13 below ledges 19. Each angle member has one leg element 25 mounted flatwise along frame side wall 18, and a second leg element 27 extending horizontally inwardly from the frame side wall parallel to the general plane of grate 11. Each leg element 25 has a circular hole receiving a cylindrical pin 29. Pin 29 could also be a threaded bolt.

Figure 2:
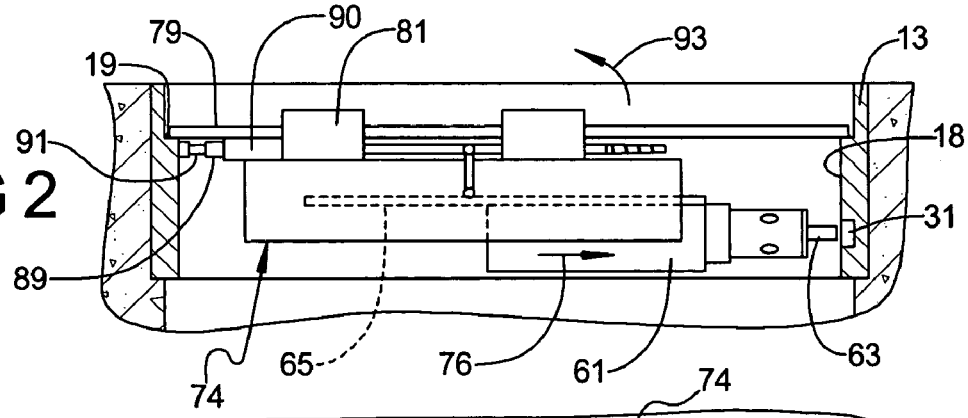
FIG. 2 is a view taken in the same direction as FIG. 1, but with the sewer grate removed from the mounting frame. A drilling fixture is shown in position on the mounting frame prior to drilling an installation hole.
Figure 3:
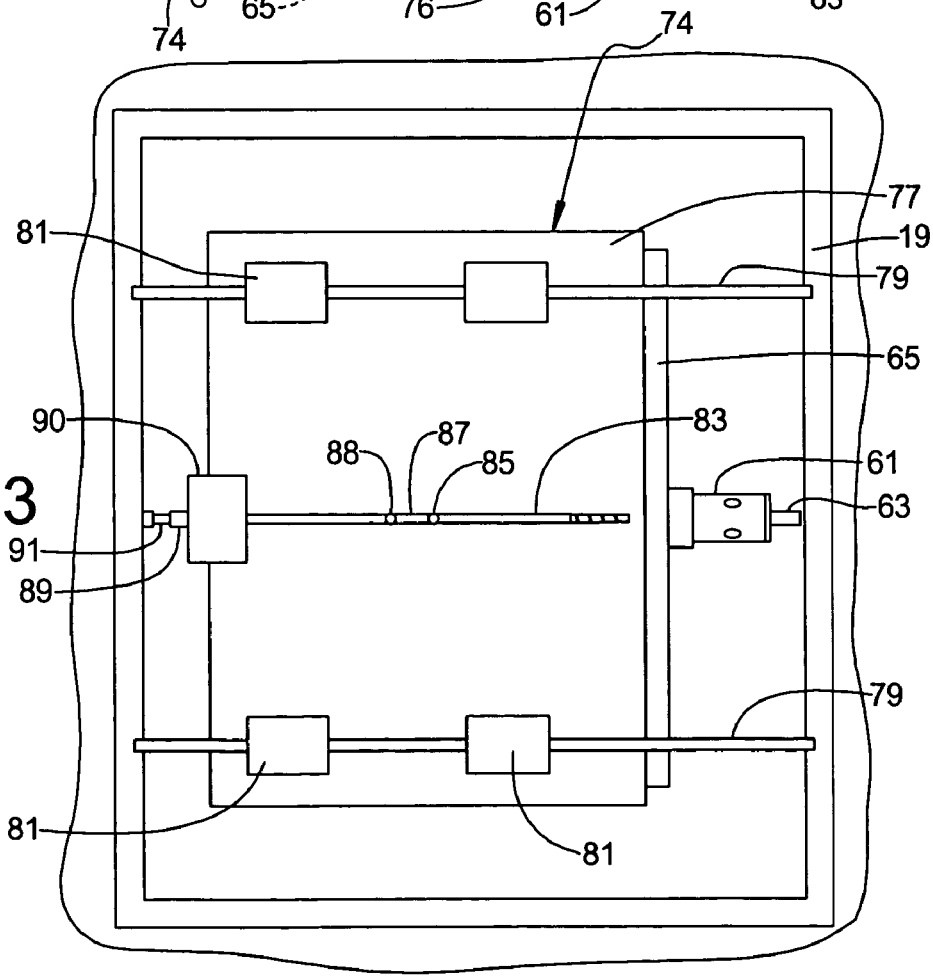
FIG. 3 is a top plan view of the drilling fixture shown in FIG. 2.
Figure 4:
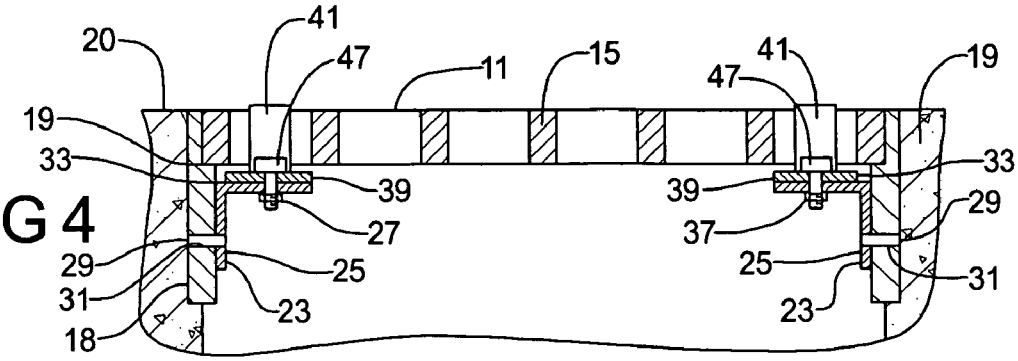
FIG. 4 is a view taken in the same direction as FIG. 1, but showing a locking mechanism of the present invention connected between the grate and its mounting frame.

As shown in FIG. 4, each pin 29 extends into a hole 31 drilled into the frame side wall, whereby the angle member has a specific orientation, dictated by the location of drilled hole 31. The purpose of each hole 31 is to properly locate the associated angle member 23 with respect to the grate. FIGS. 2 and 3 illustrate a drilling fixture used to consistently locate drilled holes 31.

Referring to FIG. 4, angle members 23 are welded, as at 33, to the frame side wall on opposite sides of the grate opening. During the welding operation, each pin 29 locates the associated angle member 23 with respect to the frame opening. Preferably, each pin 29 is hammered in a press fit in a hole 31. Also, the hole in angle member 23 has a press fit on pin 29. The welding operation is carried out after the angle member has been located into its final position, seated against the frame side wall.

Each angle member 23 is welded, as at 35, to a conventional threaded nut 37. The angle member thus supports the nut, in a permanent fixed location near one of the frame side walls.

Angle member 23 could be located by using a pair of spaced pins, a pair of spaced bolts, or a pin and a bolt located to prevent the angle member from swaying about a single pin. Using a pair of pins could be a substitute for welding the angle member to the frame side wall.

The nuts 37 are shown as separate structures welded to angle members 23. However, the nuts could alternatively be formed as threaded (tapped) holes in leg elements 27. Angle member 23 has a wall thickness of about one fourth inch, which would be sufficient for a tapped hole.

Figure 6:
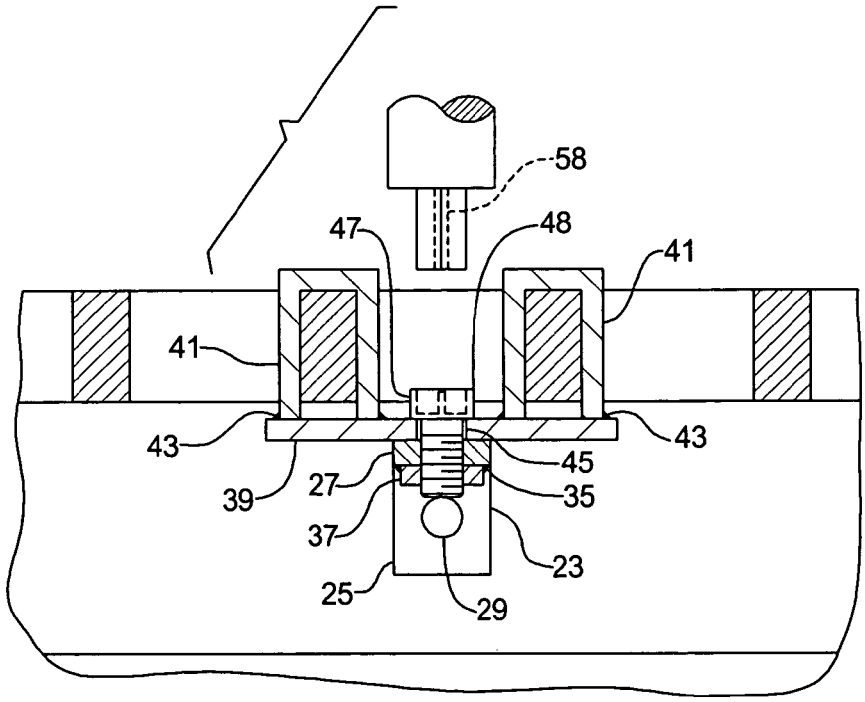
FIG. 6 is an enlarged fragmentary sectional view taken on line 6—6 in FIG. 5.

Referring to FIGS. 5 and 6, the sewer grate carries two spaced hold-down means, each including a flat rectangular plate 39 and two inverted channel elements 41. Each channel element partially encircles a grate bar 15, with the ends of the channel flanges being welded to the upper face of plate 39, as at 43. The plate-channel element assembly thus becomes a slightly loose but permanent part of the grate structure. The channel elements are welded to plate 39 with the grate removed from frame 13. Channel elements 41 support plates 39 on the underside of the sewer grate.

Each plate 39 has a hole or aperture 45 for receiving the shank of a locking bolt 47. Each bolt is screwed into the nut 37 until head 49 of the bolt abuts plate 39 to secure grate 11 and the associated plates 39 to frame 13. Leg element 27 of each angle member 23 has a clearance hole that is slightly larger than the threaded hole in nut 37, whereby the bolt can be readily threaded into or out of the nut.

Figure 7:
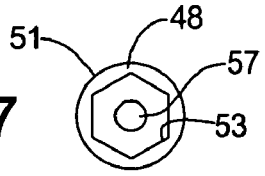
FIG. 7 is an enlarged top plan view of a locking bolt used in the mechanism of FIGS. 4 through 6.
Figure 8:
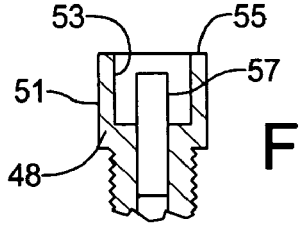
FIG. 8 is a fragmentary transverse sectional view taken through the bolt shown in FIG. 7.

Grate 11 is removed from mounting frame 13 by unscrewing the two bolts from their nuts 37. In order to prevent such removal of the grate by unauthorized persons, the head of each bolt is specially constructed so that a special wrench is required for removing the bolt. As shown in FIGS. 7 and 8, the bolt head has a cylindrical side surface 51, and a hexagonal cavity 53 extending from the top end 55 of the bolt head. A conventional, C-shaped roll pin 57 is driven into a drilled hole in the bottom of cavity 53. Pin 57 obstructs the insertion of a standard socket wrench into the cavity.

As shown in FIG. 7, cavity 53 would ordinarily accept a standard hexagonal socket wrench. A conventional socket wrench is modified by drilling an axial hole into the male wrench end of the wrench element, as at 58 in FIG. 6. Hole 58 enables the modified wrench end to be inserted into cavity 53 for screwing or unscrewing bolt 47.

FIGS. 12 and 13 illustrate an alternative locking bolt construction. In this case, the obstructing pin 57*a* is inserted as a press fit into two holes aligned on opposite sides of the bolt head cavity. The mating wrench has a standard hexagonal head modified by the addition of a slot extending across the head diameter to fit over pin 57*a*.

As seen in FIG. 6, plate 39 has its aperture 45 located midway between two grate bars 15. However manufacturing tolerances on the sewer grate and hold-down structure are such that aperture 45 may not in every instance be located exactly midway between two grate bars. Therefore, aperture 45 is preferably elongated in a direction normal to the grate bars, as shown in FIG. 6. Slight misorientations of apertured plate 39 will not interfere with the bolt being received into nut 37. As previously noted, the location of nut 37 is dictated by drilled hole 31 (FIG. 4).

FIGS. 2 and 3 illustrate a drilling fixture used to form holes 31 in frame side walls 18. The fixture comprises a conventional drilling machine 61 having a rotary chuck for mounting a drill bit 63. The drilling machine 61 is mounted on the underside of a steel plate 65.

Plate 65 constitutes a movable carriage for the drilling machine, such that movement of the plate 65 in the arrow 76 direction (FIG. 2) causes rotating drill bit 63 to form a circular hole 31 at a precise location in frame side wall 18. Carriage (plate) 65 is movably suspended from a portable bed structure 74 that comprises a rectangular ring 77, and two horizontal guide rods 79. Collars 81, containing anti-friction linear bearings, support plate 65 and guide rods 79, whereby plate 65 is free to move back and forth below the guide rods. The bed structure 74 and carriage 65 can be lifted as a unit into and out of grate mounting frame 13. The bed structure 74 is sized so that it can snugly fit into frame 13 on ledges 19.

In order to advance the drill bit 63 into the wall 18 material, a manually-operated lever mechanism is mounted on carriage 65. The lever mechanism comprises an elongated handle 83 having a pivotal connection 85 with the carriage. Link means 87 connects the handle by pivotal connection 88 to a plunger 89 that is slidable mounted in a tubular guide 90 attached to carriage 65. Plunger 89 carries an adjusting screw 91 for varying the effective length of the plunger.

With the fixture in the FIG. 2 position, handle 83 is manually swung leftwardly, as indicated by arrow 93, whereupon link means 87 exerts a leftward force on plunger 89. Plunger screw 91 braces the handle motion so that the lower end of the handle pushes carriage 65 and drill bit 63 toward the right side of wall 18. During the drilling operation, the user pulls on handle 83 to penetrate the drill bit into cast iron wall 18.

In order to drill a hole in the opposite side of wall 18, the fixture is reversed end for end, such that drill bit 63 faces leftwardly rather then rightwardly. Carriage 65 is moved in a right-to-left direction to produce the desired drill bit penetration.

The handle-linkage system of FIG. 2 is advantageous because it increases the mechanical advantage of the handle. The pushing force on the carriage is thus greater than the pulling on the handle effort. Stated differently, pulling the handle 83 through a stroke distance appreciably greater than the necessary carriage motion stroke applies a relatively great operating force to the carriage 65.

FIGS. 9 and 10 illustrate another form of the invention. In this case, each locking nut 37*a* is retained in a channel-like retainer 23*a*, such that the nut location is adjustable a limited distance along the channel length. The grate hold-down means comprises an apertured plate 39*a* formed integrally with an upstanding hook structure 41*a*.

Each retainer 23*a* is welded to a side wall 18 of the frame 13, as at 33. Prior to the welding step, the retainer is oriented on walls 18 by suitable fixturing. FIG. 11 shows in dashed lines an expansible bar-like fixture 95 having depending T-shaped grippers 97 engageable with the respective channel elements 23*a*. When the fixture is lowered onto ledges 19, the channel elements 23*a* are suitably positioned against walls 18, such that the channel elements can then be welded to frame 13 in the desired fashion. Fixture 95 serves the same general purpose as the location pins 29 in the embodiment shown in FIGS. 4 through 6. In each case the nut retainer means (23 or 23*a*) is properly oriented on frame 13 prior to its being welded to the frame. The aim is to precisely orient nut 37 or 37*a* relative to locking bolt 47.

FIGS. 4 through 6 represent the preferred embodiment of the invention. FIGS. 9 and 10 illustrate a less preferred construction that could be used in order to receive some benefits offered by the invention. The invention relates to the construction of the locking mechanism and also to the method of installing and fabricating the locking mechanism on the sewer grate and mounting frame.

The invention may be used on pre-existing sewer grates or on newly manufactured sewer grates. In the former case, the drilling and welding operations are performed in the field (at the job site). In the latter case, the drilling and welding operations are performed in a manufacturing facility. The drilling apparatus shown in FIGS. 2 and 3 is especially designed for use at the job site.

What is claimed is:

1. A locking mechanism for removably securing a sewer grate having a plurality of spaced grate bars to an associated frame comprising:

a mounting member having a first portion and a second portion, said first portion connected to said frame;

a grate hold down member, said hold down member completely encircling at least one of said grate bars of said sewer grate, said hold down member once associated with said grate being permanently coupled thereto; and at least one fastener extending through a portion of said hold down member and into engagement with said second portion of said mounting member, whereby said grate is connected to said frame via connection of said hold down member to said mounting member.

2. The locking mechanism in accordance with claim 1 wherein said hold down member comprises a plate which is located below said grate and at least one three-sided channel member which extends upwardly from said plate, over a top portion of said at least one grate bar and downwardly back to said plate.

3. The locking mechanism in accordance with claim 2 wherein said channel member is welded to said plate when said grate is removed from its frame.

4. The locking mechanism in accordance with claim 2 wherein said at least one fastener extends through an aperture in said plate, such that a head portion of said fastener is located below a top of said grate.

5. The locking mechanism in accordance with claim 1 wherein said at least one fastener is threaded and engages mating threads associated with said mounting member.

6. The locking mechanism in accordance with claim 1 wherein said mounting member comprises a generally "L"-shaped angle member.

7. The locking mechanism in accordance with claim 1 wherein said at least one fastener comprises a head having a cylindrical side surface, an end surface, and cavity extending from said end surface parallel to the cylindrical surface, said cavity comprising a plural number of internal wrench-turning flats, and an obstruction extending with the cavity space, whereby the fastener can be turned only by a wrench having external flats mated to the internal flats and depression mated to the obstruction.

8. The locking mechanism in accordance with claim 1 wherein said grate hold down member has first and second portions which completely encircle two different grate bars.

9. The locking mechanism in accordance with claim 1 wherein said fastener is positioned in an open space between two of said grate bars of said grate.

* * * * *